US006560346B2

(12) United States Patent
Ohta et al.

(10) Patent No.: US 6,560,346 B2
(45) Date of Patent: May 6, 2003

(54) PIPE MICROPHONE DEVICE

(75) Inventors: Takashi Ohta, Saitama (JP); Katsunori Murozaki, Chiba (JP); Koji Nageno, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/943,020

(22) Filed: Aug. 30, 2001

(65) Prior Publication Data

US 2002/0044670 A1 Apr. 18, 2002

(30) Foreign Application Priority Data

Sep. 1, 2000 (JP) ..... 2000-265765

(51) Int. Cl.[7] ..... H04R 25/00

(52) U.S. Cl. ..... 381/382; 381/370; 381/375

(58) Field of Search ..... 381/370, 374, 381/376, 375, 382, 381, 330, FOR 149, FOR 150; 379/430

(56) References Cited

U.S. PATENT DOCUMENTS 2,485,405 A * 10/1949 Olney et al. ..... 379/430

FOREIGN PATENT DOCUMENTS

| | | | |
|---|---|---|---|
| CA | 2070956 | * 12/1992 | ..... 379/430 |
| GB | 1377237 | * 12/1974 | ..... 381/FOR 150 |

* cited by examiner

*Primary Examiner*—Huyen Le
(74) *Attorney, Agent, or Firm*—Jay H. Maioli

(57) ABSTRACT

A microphone device having a tube made of an elastic material and a flexible core member having a shape-retaining property located inside the tube.

1 Claim, 5 Drawing Sheets

PIPE MICROPHONE DEVICE

BACKGROUND OF THE INVENTION

1. Field of the Invention

The present invention relates to a pipe microphone device preferably used in a so-called headset.

2. Description of the Related Art

Referring first to FIG. 5, construction of a general headset is explained.

This headset 1 is comprised of a head band 2, an ear receiver 3 attached to the end of the head band 2, and a pipe microphone device 4 extended from the ear receiver 3, and as shown in the drawing, the head band 2 is mounted on the head, and is worn and used with the ear receiver 3 fitted to the ear.

Reference numeral 5 is a cord, and a speaker unit built in the ear receiver 3 and a microphone unit of the pipe microphone device 4 are electrically connected to an acoustic appliance through this cord 5.

In the pipe microphone device 4 of this headset 1, a sound collector 8 at the tip end of the pipes 6 corresponds to the mouth of the user, and the voice is taken in from this sound collector 8, and is guided into the microphone unit built in the ear receiver 3.

In this pipe microphone device 4, the pipes 6 is telescopic so that the position of the sound collector 8 may be moved according to the distance from the mouth, that is, the pipes 6 is comprised of a fixed pipe 6*a* extended from the ear receiver 3, and a slide pipe 6*b* freely inserted in the fixed pipe 6*a* to move in and out, and the length of the pipes 6 is adjusted by sliding the slide pipe 6*b* on the fixed pipe 6*a*, so that the position of the sound collector 8 of the cap 7 attached to the tip end of the slide pipe 6*b* can be moved and adjusted.

The conventional pipe microphone device having such construction has the following problems.

That is, the conventional pipe microphone device is designed to adjust the position of the sound collector only by extending or contracting the pipes, it is difficult to adjust the position of the sound collector to the optimum position corresponding to the mouth position.

The pipe extension mechanism is likely to have trouble in the movable (sliding part) and lacks in reliability, and it requires precision mechanically, and the cost tends to be higher.

It is hence an object of the invention to solve these problems.

SUMMARY OF THE INVENTION

To achieve the object, the pipe microphone device of the invention comprises a flexible pipe, and a microphone disposed at the base end side of the pipe, in which the sound is taken in from the sound collector at the tip end of the pipe, and is guided into the microphone, and a flexible core member having a shape retaining property is inserted in the pipe.

The pipe microphone device of the invention having such construction is capable of adjusting the position of the sound collector to the optimum position corresponding to the mouth position only by deflecting the pipe freely.

DETAILED DESCRIPTION OF THE PREFERRED EMBODIMENTS

Figure 1:
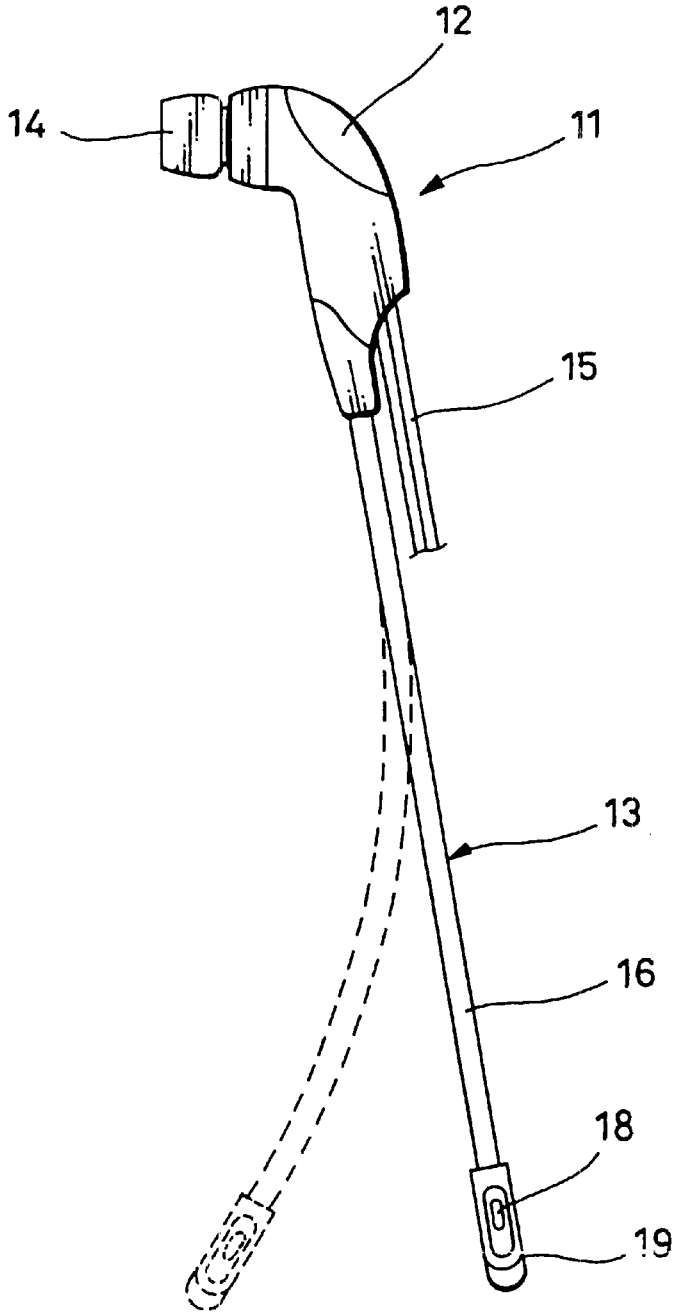
FIG. 1 is a front view of a headset having a pipe microphone device of the invention.

Referring now to the drawings, preferred embodiments of the invention are described below.

FIG. 1 shows a headset to which a pipe microphone device of the invention is applied.

This headset 11 is comprised of an ear receiver 12, and a pipe microphone device 13 extended from the ear receiver 12.

A speaker unit is built in the ear receiver 12, and an ear pad 14 made of, for example, silicone rubber is attached to the sound release side of the speaker unit, and this ear pad 14 is inserted into an earhole, and the headset 11 is worn.

Reference numeral 15 is a cord, and the speaker unit built in the ear receiver 12 and the microphone unit of the pipe microphone device 13 are electrically connected to the acoustic appliance through this cord 15.

Figure 2:
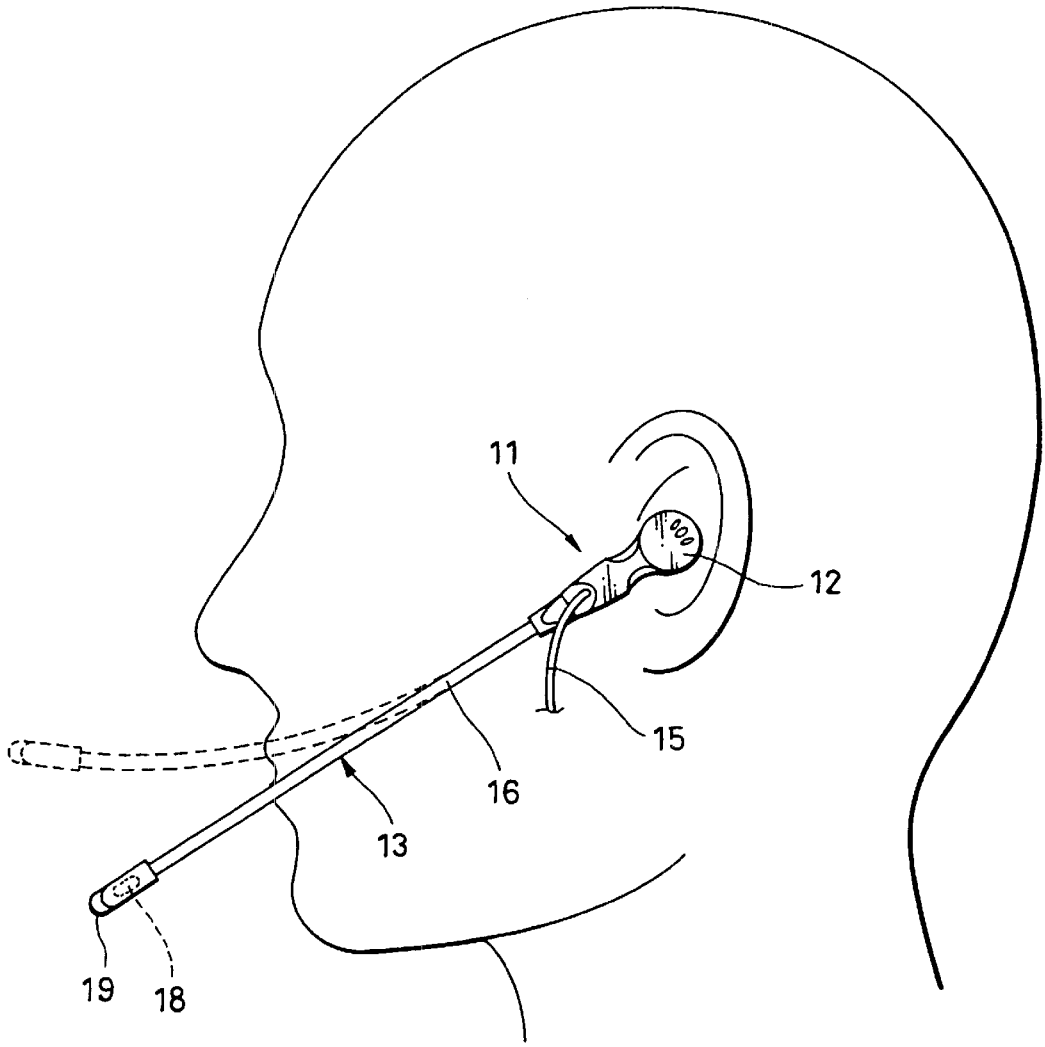
FIG. 2 is an explanatory diagram of a state of use of the headset in FIG. 1.

The state of use of the headset 11 is shown in FIG. 2.

As shown in the drawing, the headset 11 of the embodiment is worn by inserting the ear pad of the ear receiver 12 into the earhole, and is used in a state of the sound collector 18 of the pipe microphone device 13 being set at a position corresponding to the mouth.

In this headset 11, the pipe microphone device 13 is designed to adjust the position of the sound collector 18 accurately to the mouth position by freely deflecting a pipe 16.

Figure 3A:
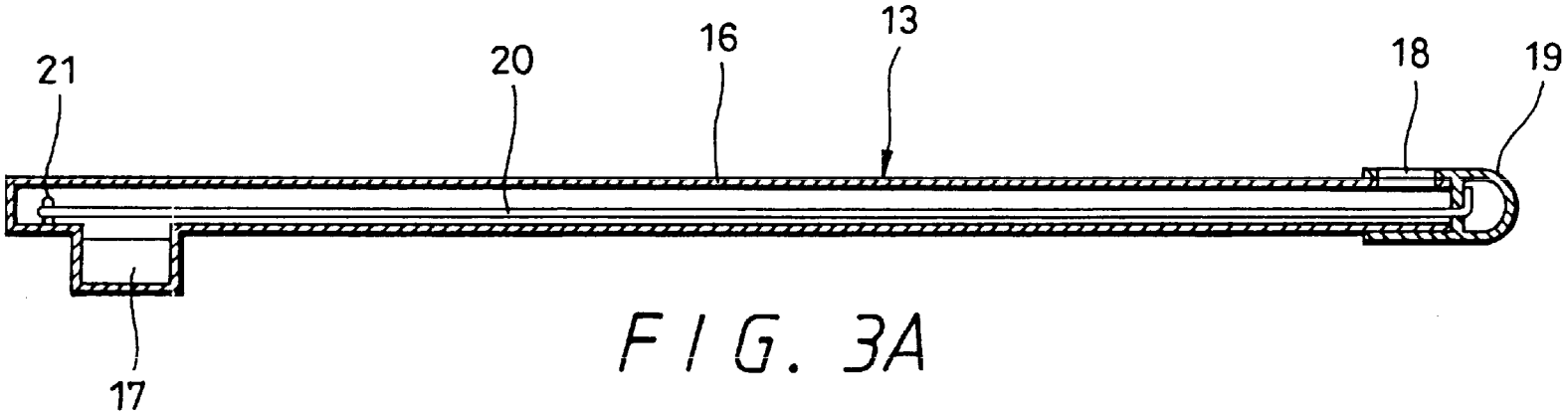
FIG. 3 shows a first embodiment of pipe microphone device of the invention, in which (A) is a longitudinal sectional view, and (B) is a magnified longitudinal direction in its orthogonal direction.
Figure 3B:
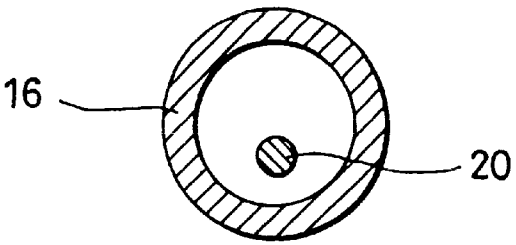

A first embodiment of the pipe microphone device is shown in FIG. 3.

In the diagram, (A) is a longitudinal sectional view of the pipe microphone device, and (B) is a magnified sectional view in a direction orthogonal thereto.

The pipe 16 of the pipe microphone device 13 is flexible, its material is a soft resin material such as vinyl chloride and silicone.

The length of the pipe 16 is about 10 to 15 cm, the outside diameter is about 3.0 to 5.0 mm, and the inside diameter is about 2.0 to 4.0 mm.

A microphone unit 17 is disposed at the base end side of the pipe 16, and a cap 19 having a sound collector 18 is attached to the tip end side, and the voice is taken in from the sound collector 18 of the cap 19, and is guided into the microphone unit 17.

The base end side of the pipe 16 is incorporated into the ear receiver 12 of the headset 11 including the microphone unit 17.

A flexible core member 20 having shape retaining property is built in the pipe 16 of the pipe microphone device 11. The flexible core member 20 is a wire of about 0.5 to 1.0 mm in diameter made of plastic metal such as aluminum, zinc or copper, and it is inserted in the hollow space of the pipe 16 almost in its overall length.

In this embodiment, in particular, one end of the flexible core member 20 is fitted to the cap 19, and other end is fitted to a protrusion 21 disposed at the base end side of the pipe 16, and the cap 19 is held so that the cap 19 may not slip off the pipe 16.

In the pipe microphone device 13 having such construction, the position of the sound collector 18 may be adjusted to the optimum position corresponding to the mouth accurately by freely deflecting the pipe 16, and in this state, therefore, the shape of the pipe 16 is maintained by the shape retaining property (plasticity) of the flexible core member 20.

Accordingly, with this pipe microphone device 13, the voice release from the mouth can be taken in securely.

This pipe microphone device 13 is simple in costruction, that is, not having complicated costruction, trouble hardly occurs, and a high reliability is assured. Further, since the costruction is simple, it can be presented at light weight and low cost.

In this pipe microphone device 13, moreover, since the flexible core member 20 is also used for preventing slip-out of the cap 19 having the sound collector 18 attached to the tip end side of the pipe 16, no extra means for preventing slip-out of the cap 19 is needed, and the costruction is further simplified.

Figure 4A:
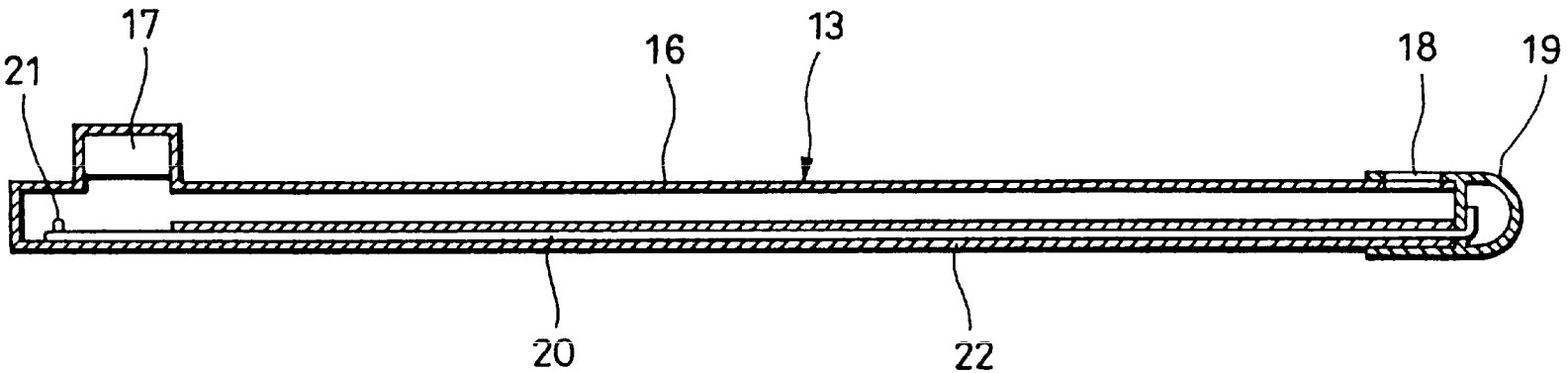
FIG. 4 shows a second embodiment of pipe microphone device of the invention, in which (A) is a longitudinal sectional view, and (B) is a magnified longitudinal direction in its orthogonal direction.
Figure 4B:
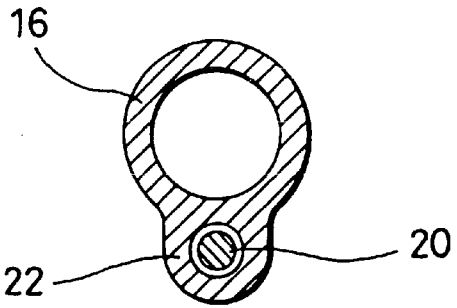
Figure 5:
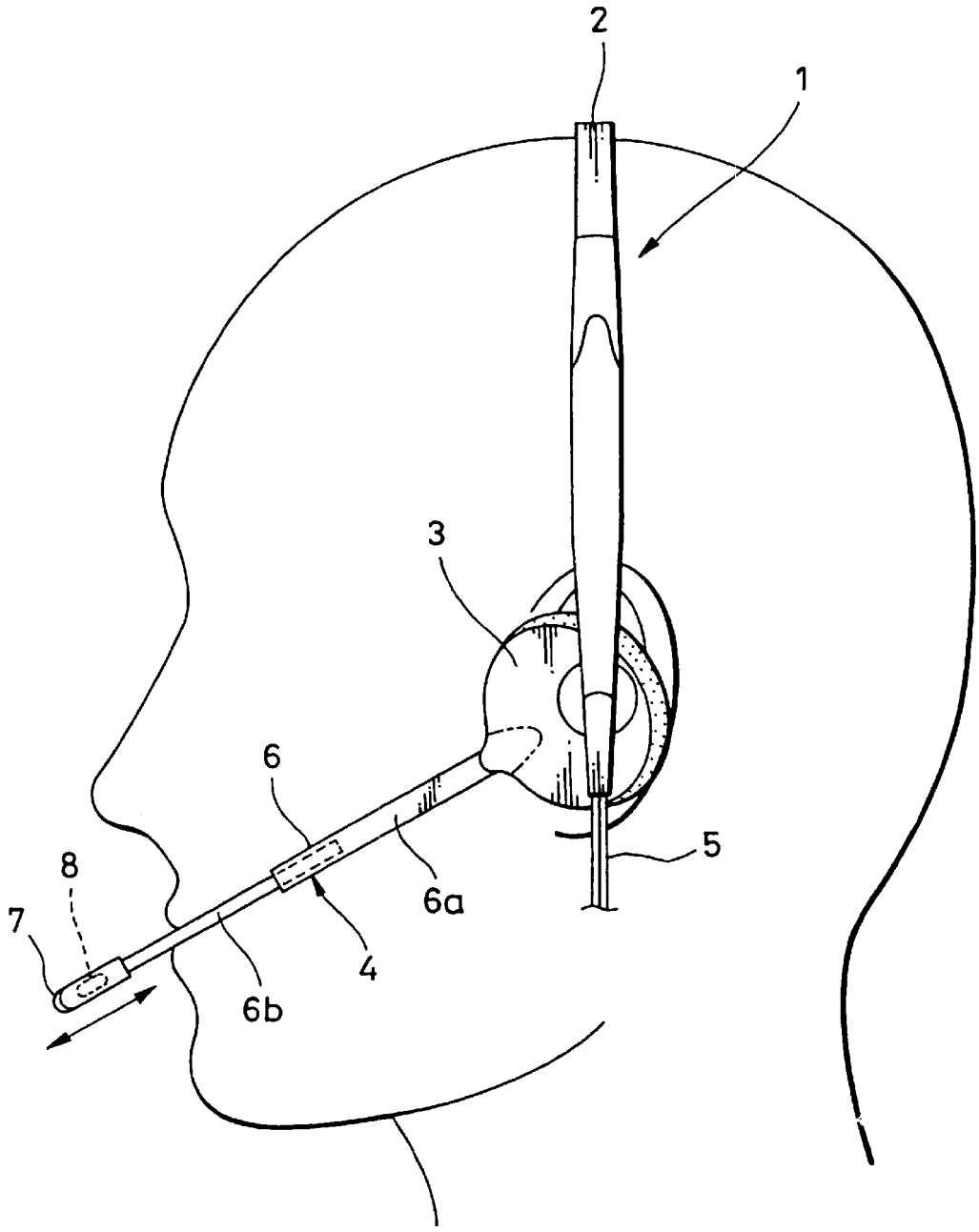
FIG. 5 (PRIOR ART)
FIG. 5 is an explanatory diagram of a prior art.

FIG. 4 shows a second embodiment of the pipe microphone device 13.

In the diagram, (A) is a longitudinal sectional view of the pipe microphone device, and (B) is a magnified sectional view in a direction orthogonal thereto.

In the second embodiment, the same parts as in the first embodiment are identified with same reference numerals and their description is omitted.

In the foregoing first embodiment, the flexible core member 20 is passed in the hollow space in the pipe 16, but in the second embodiment, the flexible core member 20 is buried in the pipe 16 and passed therethrough.

That is, in the pipe microphone device 11 of the second embodiment, a pipe part 22 for flexible core member is formed integrally with the pipe 16, and the flexible core member 20 is buried through this pipe part 22.

In the pipe microphone device of the second embodiment having such construction, in addition to the advantageous effects of the first embodiment, since the flexible core member 20 is buried in the pipe 16 and passed therethrough, the flexible core member 20 does not have any adverse effect on the sound passing through the pipe 16, so that the sound can be taken in more accurately.

Embodiments of the invention are illustrated herein, but it must be noted, however, that the invention is not limited to these embodiments alone.

The pipe microphone device of the invention is applied not only to the headset as described in the embodiments, but also to, for example, a helmet or cap.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A pipe microphone device comprising:

a flexible pipe;

a microphone arranged inside the pipe at a base end thereof;

a cap mounted over a tip end of the pipe and having a sound collector aperture formed therein, wherein sound is received by the sound collector aperture and is guided into the microphone; and a flexible core member having a shape-retaining property is inserted into the pipe and one end thereof is captured at the base end of the pipe, wherein said flexible core member has an element at an opposite end to retain the cap on the tip end of the pipe.

* * * * *